US008260451B2

(12) United States Patent
Takeichi

(10) Patent No.: US 8,260,451 B2
(45) Date of Patent: Sep. 4, 2012

(54) EYEGLASS LENS PROCESSING APPARATUS

(75) Inventor: Kyoji Takeichi, Aichi (JP)

(73) Assignee: Nidek Co., Ltd., Aichi (JP)

( * ) Notice: Subject to any disclaimer, the term of this patent is extended or adjusted under 35 U.S.C. 154(b) by 280 days.

(21) Appl. No.: 12/792,438

(22) Filed: Jun. 2, 2010

(65) Prior Publication Data

US 2010/0311310 A1 Dec. 9, 2010

(30) Foreign Application Priority Data

Jun. 3, 2009 (JP) ..... 2009-133722

(51) Int. Cl.
*G06F 19/00* (2011.01)
*B24B 49/00* (2012.01)

(52) U.S. Cl. ..... 700/164; 451/5

(58) Field of Classification Search ..... 700/164; 451/5, 6, 42, 43
See application file for complete search history.

(56) References Cited

U.S. PATENT DOCUMENTS 5,333,412 A 8/1994 Matsuyama
6,048,258 A 4/2000 Shibata
6,074,280 A 6/2000 Mizuno
6,328,630 B1 * 12/2001 Jinbo et al. ..... 451/11
6,497,614 B2 * 12/2002 Kobayashi et al. ..... 451/43
6,790,124 B2 9/2004 Shibata
8,162,719 B2 * 4/2012 Hasegawa et al. ..... 451/5

FOREIGN PATENT DOCUMENTS

JP 04-093164 A 3/1992
JP 10-328991 A 12/1998
JP 11-090805 A 4/1999
JP 2003-145328 A 5/2003

* cited by examiner

*Primary Examiner* — Dave Robertson
(74) *Attorney, Agent, or Firm* — Sughrue Mion, PLLC

(57) ABSTRACT

An eyeglass lens processing apparatus comprising a processing control unit which performs polishing by controlling a lens rotating unit, a grindstone rotating unit and an axis-to-axis distance varying unit based on an input target lens shape so as to process a periphery of a lens, which has been finished, by a lens margin allowed for polishing by the polishing grindstone. The processing control unit controls the lens rotating unit, the grindstone rotating unit and the axis-to-axis distance varying unit based on a lens rotating speed V1 and the grindstone rotating speed Vw at least at the final rotation of the lens. The lens rotation speed V1 and the grindstone rotation speed Vw satisfy a condition in which an average interval between cyclic stripes appearing on a processed surface of the lens due to height fluctuations of the polishing grindstone is smaller than eye's resolution or is larger than 2 mm.

9 Claims, 6 Drawing Sheets

EYEGLASS LENS PROCESSING APPARATUS

BACKGROUND OF THE INVENTION

The present invention relates to an eyeglass lens processing apparatus for processing a periphery of a lens into a polished surface.

The periphery of the eyeglass lens to be held by an eyeglass frame is roughly processed (roughed) by a roughing tool of the eyeglass lens processing apparatus, and then, finished by a finishing tool. In recent years, with the weight reduction and design quality improvement of eyeglass frames, frames of a type in which a lens is held by a thin wire and rimless frames have become widespread, and importance has been placed on appearance of edge surfaces of lenses. To cope with this, a processing is performed in which an edge surface of a white finished surface is further polished by a polishing grindstone to a polished state so as to be transparent (Japanese Unexamined Patent Application Publication No. H11-90805 [U.S. Pat. No. 6,074,280]).

In polishing, the polishing grindstone having a smaller particle size than a finishing grindstone is used. For this reason, generally, conditions such as the rotation speed of the lens and the rotation speed of the polishing grindstone are set so as to preventing a burn of the processed edge surface of the lens (a condition where the transparency of the lens is low) caused by the heat generated at the time of processing. However, stripes at fine intervals due to light reflection at the polished surface appear in the thickness direction of the edge like the stripes formed on the edge surface of a coin. Therefore, a further improvement in the appearance of polished surfaces is required.

SUMMARY OF THE INVENTION

In view of the above-mentioned problem of the related art, an object of the present invention is to provide an eyeglass lens processing apparatus capable of obtaining a good-looking polished surface by making inconspicuous the stripes appearing on the edge surface of the polished lens.

Means for Solving the Problem

To solve the above-mentioned problem, the present invention is provided with:

(1) An eyeglass lens processing apparatus for processing a peripheral edge of an eyeglass lens, comprising:

a lens rotating unit including a lens chuck shaft for holding the lens and a motor for rotating the lens chuck shaft;

a grindstone rotating unit including a spindle attached to a polishing grindstone and a motor for rotating the spindle;

an axis-to-axis distance varying unit including a motor for changing an axis-to-axis distance between the lens chuck shaft and the spindle;

a data input unit which inputs target lens shape data;

a memory which stores a rotation speed of the lens and a rotation speed of the polishing grindstone, which satisfy a condition in which an average interval between cyclic stripes appearing on a processed edge surface of the lens which are generated due to height fluctuations of a processing surface of the polishing grindstone with respect to a rotation center of the spindle during one rotation of the polishing grindstone is smaller than human eye's resolution or is larger than 2 mm; and a processing control unit for performing polishing by controlling the lens rotating unit, the grindstone rotating unit and the axis-to-axis distance varying unit based on the input target lens shape data so as to polish the peripheral edge of the lens, which has been finished, by a lens margin allowed for polishing by the polishing grindstone, wherein the processing control unit controls the lens rotating unit and the grindstone rotating unit based on the lens rotating speed and the grindstone rotating speed stored in the memory at least at the final one rotation of the lens.

(2) The lens processing apparatus according to (1), wherein the lens rotating speed and the grindstone rotating speed satisfy a condition in which the average interval between the stripes which are generated when the lens is polished into the target lens shape having a normal peripheral length is smaller than the human eye's resolution or larger than 2 mm.

(3) The lens processing apparatus according to (1), wherein the lens rotating speed and the grindstone rotating speed satisfy a condition in which the average interval between the stripes which are generated when the lens is polished into the target lens shape having a peripheral length corresponding to a size of 30-50 mm in diameter is smaller than the human eye's resolution or larger than 2 mm.

(4) The lens processing apparatus according to (1), wherein the average interval between the stripes is a value obtained by dividing a peripheral length of the target lens shape by N, where N=the lens rotating speed time per one rotation×the grindstone rotating speed rotation per time.

(5) The lens processing apparatus according to (4), wherein the lens rotating speed and the grindstone rotating speed satisfy a condition in which N is larger than 2520 or smaller than 63.

(6) The lens processing apparatus according to (1), wherein the processing control unit performs the polishing by changing a rotation speed of the lens and a rotation speed of the polishing grindstone according to a first stage in which most of the lens margin allowed for polishing is polished by rotating the lens a predetermined rotation and a second stage in which the lens is polished by rotating the lens a predetermined rotation including the final one rotation, at the first stage, the processing control unit controls the lens rotating unit and the grindstone rotating unit based on a rotation speed of the lens and a rotation speed of the polishing grindstone which are set to satisfy a condition that no burn is caused on the processed edge surface of the lens, and at the second stage, the processing control unit controls the lens rotating unit and the grindstone rotating unit based on the lens rotation speed and the grindstone rotation speed stored in the memory.

(7) The eyeglass lens processing apparatus according to (1), the processing control unit controls the axis-to-axis distance varying unit so as to polish a minute lens margin every lens rotation, and controls the lens rotating unit and the grindstone rotating unit based on the lens rotation speed and the grindstone rotation speed stored in the memory until the minute lens margin becomes the overall lens margin allowed for polishing.

(8) The eyeglass lens processing apparatus according to (1), the processing control unit controls the lens rotating unit to rotate the lens at the constant speed of the lens rotation speed stored in the memory at least at the final one rotation.

(9) The eyeglass lens processing apparatus according to (1), wherein the processing control unit obtains a speed at each rotation angle of the lens based on the target lens shape and a diameter of the polishing grindstone so as to satisfy the lens rotation speed stored in the memory and so that a movement speed of a point where the lens is in contact with the polishing grindstone is substantially constant, and controls the lens rotating unit based on the obtained speed at least at the final one rotation.

According to the present invention, the stripes appearing on the edge surface of the polished lens can be made inconspicuous, so that a good-looking polished surface can be obtained.

DESCRIPTION OF EXEMPLARY EMBODIMENTS

Hereinafter, an embodiment according to the present invention will be described based on the drawings. Prior to the description of the embodiment of an eyeglass lens processing apparatus to which the present invention is applied, it will be explained why cyclic stripes appear in a thickness direction of the lens edge after polishing by the polishing grindstone.

Figure 1:
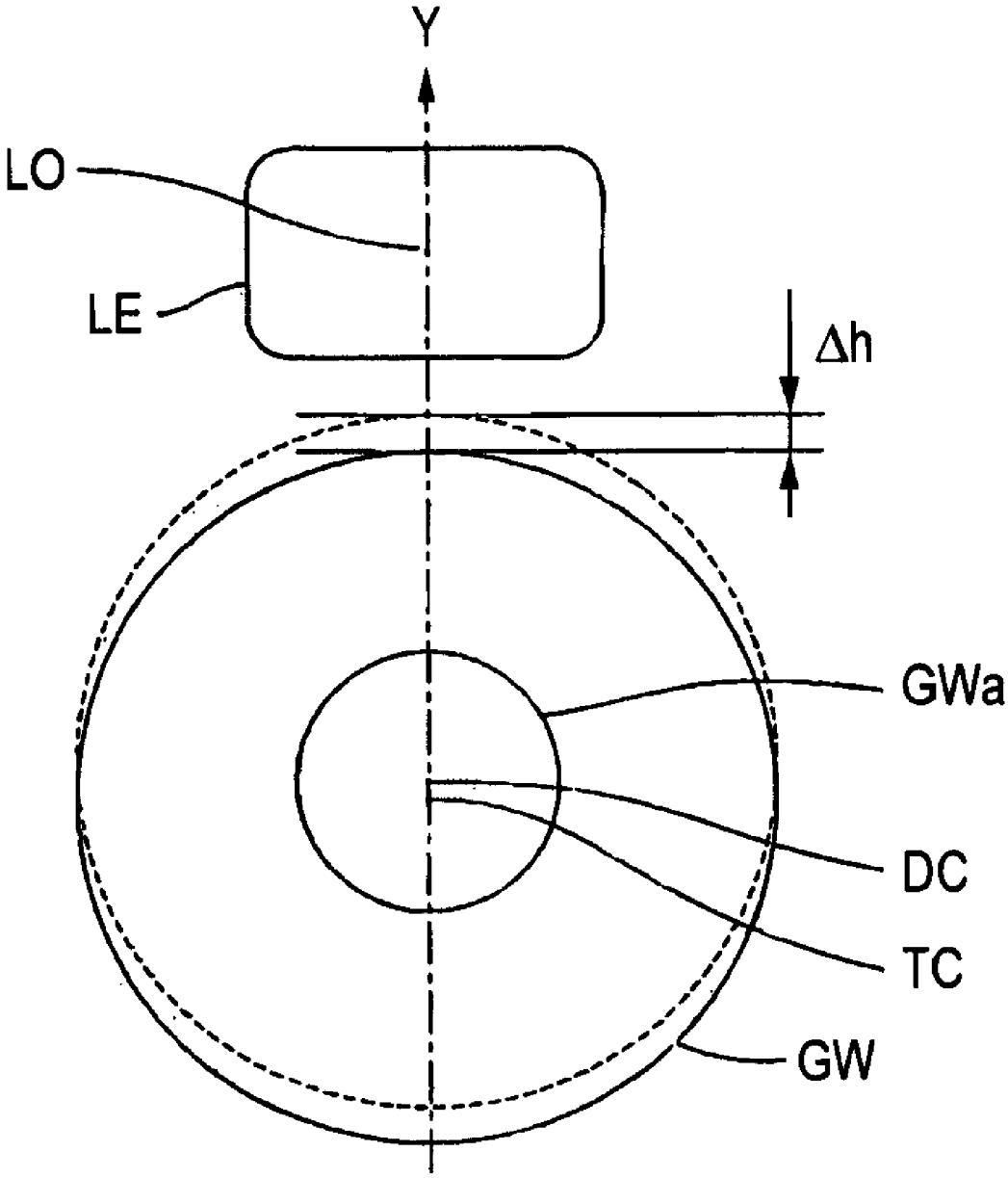
FIG. 1 is a view for explaining height fluctuations of a processing surface caused by one rotation of a polishing grindstone.

FIG. 1 is a view for explaining height fluctuations of a processing surface caused by one rotation of a polishing grindstone. In FIG. 1, a lens LE having been finished is rotated with respect to a chuck center LO and is moved in a y-axis direction, and the periphery thereof is polished by the polishing grindstone GW. The polishing grindstone GW to which a spindle (grindstone rotation axis) is attached is rotated with respect to a rotation center DC of a spindle. When the polishing grindstone GW is rotated once, the height (the position in the y-axis direction in FIG. 1) of the processing surface of the polishing grindstone GW is not invariant but vertically fluctuates by $\Delta h$ at least on the order of microns. This results mainly from the decentering of the center TC of the polishing grindstone GW with respect to the rotation center DC of the spindle. A hole GWa through which the spindle is inserted is formed in the center of the polishing grindstone GW, and the polishing grindstone GW is fixed to the spindle. However, it is extremely difficult to strictly ensure the accuracy of the center position of the hole GWa with respect to the polishing grindstone GW, and the center position is decentered at least on the order of microns. Moreover, another factor such as a deviation of the outer diameter of the polishing grindstone GW from a perfect circle or vibrations of the spindle when it is rotated is also considered as a factor of the height fluctuations of the processing surface of the polishing grindstone GW.

Figure 2:
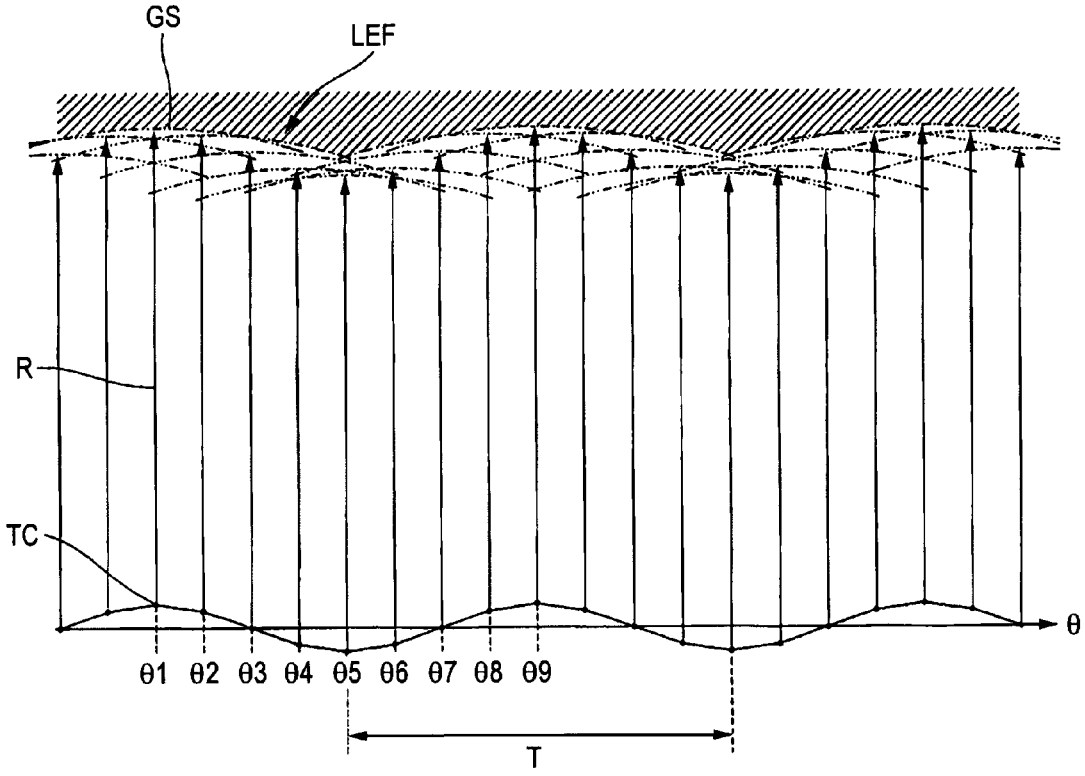
FIG. 2 is a view for explaining periodical fluctuations appearing on a processed surface of a lens.

When such height fluctuations of the processing surface of the polishing grindstone GW occur, even if the height (the position in the y-axis direction) of the lens LE is controlled so that the edge surface is polished at a fixed height, as shown in FIG. 2, the processed edge surface LEF of the lens is processed so as to wave cyclically. FIG. 2 is a view for explaining the cyclical fluctuations appearing on the processed edge surface LEF of the lens LE. In FIG. 2, GS represents the processing surface of the polishing grindstone GW having a radius R.

In FIG. 2, the center TC of the polishing grindstone GW relatively moves rightward in FIG. 2 as the rotation angle θ (θ1, θ2, θ3, . . . ) of the lens LE changes, and when the polishing grindstone GW is rotated once, the height (the position in the y-axis direction) of the center TC thereof changes sinusoidally. The position of the lens LE in the y-axis direction is controlled so that the processed surface LEF of the lens LE is approximately linearly processed.

When the height of the center TC of the polishing grindstone GW descends successively at rotation angles θ2, θ3, θ4 and θ5 with respect to the rotation angle θ1, since the uppermost end of the processing surface GS also gradually descends, the processed edge surface LEF of the lens LE is processed so as to gradually descend. The processed edge surface LEF of the lens LE is lowest at the rotation angle θ5 where the center TC of the polishing grindstone GW is located at the lowermost point. Then, when the height of the center TC of the polishing grindstone GW ascends successively at rotation angles θ6, θ7, θ8 and θ9, the processed edge surface LEF of the lens LE is processed so as to gradually ascend. While the center TC of the polishing grindstone GW and the uppermost end of the processing surface GS vary sinusoidally, the processed surface LEF of the lens LE results in a shape with which the shape of the processing surfaces GS having the radius R is combined, and is processed into a chevron shape that is pointed at the position of the rotation angle θ5.

Since the polishing grindstone GW is rotated once at the rotation angles θ1 to θ9, a chevron processed surface appears on the lens edge surface in this cycle. Since the direction of the light reflection at the processed surface also cyclically changes with the cyclic change of the processed surface, this is observed as cyclic stripes appearing in the direction of the edge thickness on the polished edge surface.

The height fluctuations of the processed surface LEF were checked under conventional polishing conditions. The outer shape of the lens LE was a circle with a diameter of 40 mm, and as the processing conditions for polishing after finishing, the lens rotation speed V1 was 15 seconds per rotation, and the rotation speed Vw of the polishing grindstone GW was 2000 rpm (2000 rotations per minute). The lens margin allowed for polishing after finishing was 0.1 mm, and the lens LE is rotated four times to process the lens margin which is 0.1 mm. The conditions were set so that the processing efficiency was high without a burn and an unprocessed part on the processed surface of the lens with a polishing grindstone whose particle size is #400 and that the time for polishing was not prolonged. As a result of checking the height and interval of the chevron shapes on the processed surface polished under these conditions with a microscope, the height difference was several microns, and the cyclic interval between the stripes was approximately 0.3 mm on the average. The stripes at such intervals are observed as conspicuous when viewed from a direction in which the reflected light at the edge is intensified.

Next, a method of setting processing conditions for making the cyclic stripes inconspicuous will be described. By finding the cause of the cyclic stripes as described above, it was found that the number N of stripes appearing during one rotation of the lens depends on the number of rotations of the polishing grindstone GW per rotation of the lens based on the relationship between the rotation speed of the lens and the rotation speed of the polishing grindstone GW. That is, when the rotation speed of the lens per rotation of the lens is V1 (second per rotation) and the rotation speed of the polishing grindstone is Vw (the number of rotations per second), the number N of stripes is expressed by the following relational expression:

$$N = V1 \times Vw \quad \text{(expression 1)}$$

When the unit of the rotation speed of the grindstone is rpm (the number of rotations per minute), the number N is obtained by dividing the above relational expression by 60 seconds. The number N is also the number of rotations of the polishing grindstone GW per rotation of the lens.

For example, when the lens rotation speed V1 is 15 seconds per rotation and the rotation speed Vw of the polishing grindstone GW is 2000 rpm (33.3 rotations per second) as in the above-described case, the number N is 500. When the outer shape (target lens shape) of the lens LE is a circle with a diameter of 40 mm, by dividing the length of the periphery around the lens, approximately 126 mm, by N=500, the interval between the stripes is calculated as approximately 0.25 mm. This value is substantially similar to the result of the above-described check.

The stripes appearing on the periphery around the lens can be made inconspicuous by two methods described below. A first method is to increase the number N of stripes so that the interval (the distance I in FIGS. 3A-3B) between the stripes appearing on the lens periphery is finer than the human eye's resolution. On the contrary, a second method is to increase the interval between the stripes appearing on the lens periphery to reduce the number N of stripes so that the interval is not annoying as a fine interval. In other words, a certain target lens shape size of a lens to be polished is assumed (a lens having a desired diameter is assumed), and the conditions of the rotation speed of the lens and the rotation speed of the polishing grindstone are set so that the interval when the overall length of the periphery of the lens is divided by the number N of the expression 1 is either smaller than the human eye's resolution or larger than a distance assumed large enough to be difficult to be visually conspicuous.

The condition setting by the first method will be described. An interval of 0.1 to 1.0 mm is a distance sufficiently recognized by the eye having a normal resolution. It is said that the human eye's resolution (the ability to recognize adjoining two points) is, in the case of a normal eye, 0.06 mm (visual angle 50 arcseconds) when the distance of distinct vision is 250 mm. Therefore, when the interval between the stripes is smaller than 0.06 mm and not more than 0.05 mm, the stripes are difficult to recognize as stripes, and when the interval is not more than 0.01 mm, the stripes can be no longer recognized by the eye.

For example, when a circle with an average diameter of 40 mm (the radius from the rotation center is 20 mm) is assumed as the target lens shape of the lens LE to be polished, the overall length of the lens periphery is approximately 1126 mm, and the number N when the interval between the cyclic stripes is 0.05 mm is 2520. When the lens rotation speed V1 is 15 seconds per rotation as a condition for the number N to be 2520, the grindstone rotation speed Vw is 10080 rpm (the number of rotations per minute). When the grindstone rotation speed Vw is 6000 rpm (the number of rotations per minute), the lens rotation speed V1 is 25.2 seconds per rotation.

When the target lens shape of the lens is the same as the above-described one and more desirably, the interval between the cyclic stripes is 0.01 mm, the number N is 12600. When the lens rotation speed V1 is 15 seconds per rotation as a condition for the number N to be 12600, the grindstone rotation speed Vw is 50400 rpm (the number of rotations per minute). When the grindstone rotation speed Vw is 6000 rpm (the number of rotations per minute), the lens rotation speed V1 is 126 seconds per rotation.

The condition setting by the second method will be described. According to the second method, the lens rotation speed V1 is increased and the grindstone rotation speed Vw is decreased in order to maximize the interval (the distance I in FIGS. 3A-3C) between the stripes. However, if the lens rotation speed V1 is too high, when the radius vector length from the rotation center is drastically changed (for example, when the target lens shape is a square), there is a possibility that the movement of the lens in the y-axis direction does not catch up and the accuracy of the processing shape of the lens cannot be ensured. If the grindstone rotation speed Vw is too low, there is a possibility that stable rotation of the polishing grindstone cannot be ensured. Therefore, for example, when the lens rotation speed V1 at which the accuracy of the processing shape of the lens can be ensured with stability is four seconds per rotation and the grindstone rotation speed Vw at which stable rotation of the polishing grindstone can be ensured is 500 rpm as processing conditions, the number N is approximately 33. When a diameter of 40 mm is assumed as the target lens shape size, the length of the lens periphery is approximately 126 mm, and the interval divided by N=33 is approximately 3.8 mm.

According to an experiment by the present inventor, it was found that when the interval between the cyclic stripes is 0.1 to 1 mm, the stripes are conspicuous but when the interval is 2 mm, they are difficult to recognize as stripes. When the interval is not less than 3 mm, the stripes that appear due to light reflection are unobservable. Therefore, if at least the interval is not less than 2 mm, the stripes are inconspicuous, so that a polished surface better-looking than conventional ones is obtained. More desirably, if the interval is not less than 3 mm, an extremely good-looking polished surface can be obtained.

For example, the number N where the target lens shape size is 40 mm in diameter and the interval is 2 mm is 63, and the number N where the interval is 3 mm is approximately 42. When the grindstone rotation speed Vw is 500 rpm as a condition for the number N to be 42, the lens rotation speed V1 is approximately five seconds per rotation, and processing accuracy can be ensured. When the lens rotation speed V1 is four seconds per rotation as a condition for the number N to be 42, the grindstone rotation speed Vw is 630 rpm, and stable rotation can be ensured.

Even when the interval between the stripes is 0.05 mm in the condition setting by the first method, in order that the lens rotation speed V1 is 15 seconds per rotation which is the same as the conventional speed, it is necessary that the grindstone rotation speed Vw be 10080 rpm (the number of rotations per minute). For this, a motor with high rotatory power (or a rotation transmission mechanism that increases the rotation speed) is required as the motor for rotating the grindstone. Such a motor (or a mechanism) is expensive, and disadvantageous in that the apparatus is increased in size. When a motor the highest rotation speed of which is 6000 rpm is used, the lens rotation speed V1 is 25.2 seconds per rotation, and a longer processing time than before is required. On the contrary, when the conditions of the second method are applied, polishing can be performed without the use of a high rotatory power motor and without any increase in the polishing time.

Figure 3A:
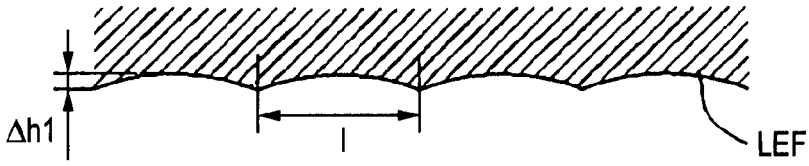
FIG. 3A is a schematic view showing a result of a simulation of the height fluctuations of the processed surface under conventional processing conditions.
Figure 3B:
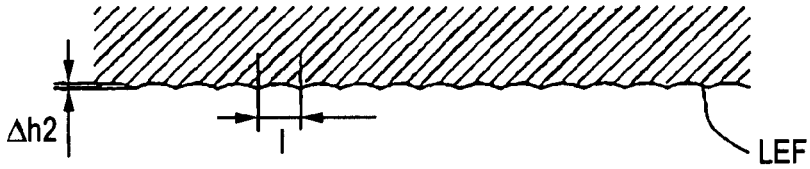
FIG. 3B is a schematic view showing a result of a simulation of the height fluctuations of the processed surface under processing conditions by a first method.
Figure 3C:
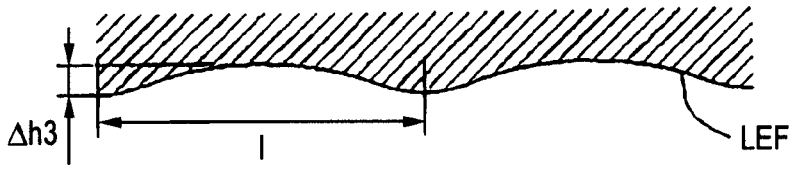
FIG. 3C is a schematic view showing a result of a simulation of the height fluctuations of the processed surface under processing conditions by a second method.

FIGS. 3A to 3C are schematic views showing results of simulations of the height fluctuations of the processed surface LEF under the conventional processing conditions, the processing conditions of the first method and the processing conditions of the second method. FIG. 3A shows the result under the conventional processing conditions. Like FIG. 2, chevron fluctuations having pointed parts at a height Δh1 appear on the processed surface LEF. FIG. 3B shows a case where the interval (distance I) between the cyclic stripes under the conditions of the first method. In this case, the height Δh2 of the fluctuations of the processed surface LEF is smaller than Δh1 of FIG. 3A. Therefore, it is considered that the stripes are less conspicuous than in the case of FIG. 3A. FIG. 3C shows a case where the interval (distance I) between the cyclic stripes is increased under the conditions of the second method. In this case, although the height Δh3 of the fluctuations of the processed surface LEF is larger than Δh1 of FIG. 3A, since the cycle is longer, the pointed chevron fluctuations are moderated and the fluctuations are gentle. Therefore, it is considered that the stripes are less conspicuous than in the case of FIG. 3A.

In the first method or the second method, when the rotation speed at each minute rotation angle of the lens is constant at the lens rotation speed V1 and when the target lens shape is not a circle, the interval between the stripes is partly different. However, by the average interval satisfying conditions as mentioned above, as a whole, the stripes can be made less conspicuous than before, so that a good-looking polished surface can be obtained.

Figure 4:
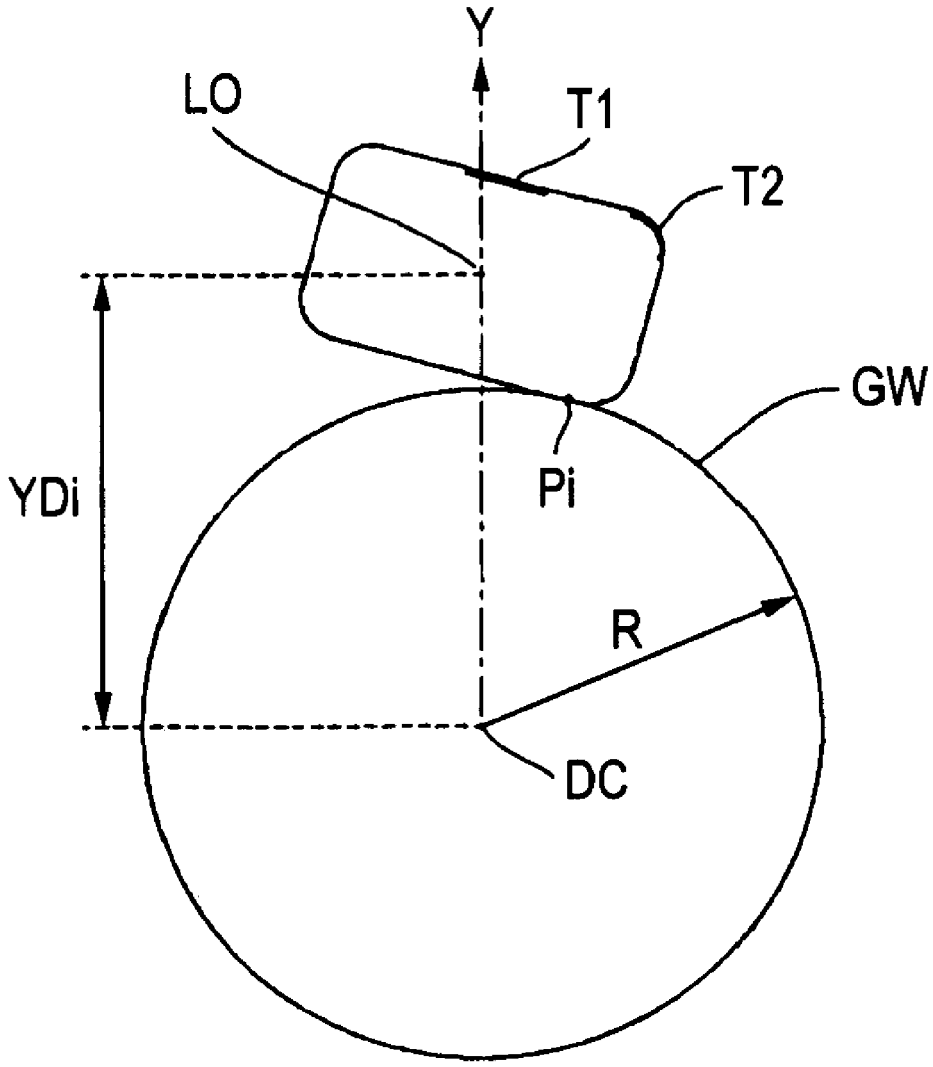
FIG. 4 is a view showing a contact point where the lens is in contact with the polishing grindstone at the time of polishing.

When the target lens shape is not a circle, a polished surface with a higher finished accuracy can be obtained by making the rotation speed at each lens rotation angle θi (i=1, 2, 3, . . . , N) not constant but as follows: As shown in FIG. 4, the motor for rotating the lens is controlled in such a manner that the rotation speed data at each lens rotation angle θi is obtained so that the movement speed (the movement speed in a direction along the outer shape of the lens) of the contact point Pi where the lens LE is in contact with the polishing grindstone GW is substantially constant. For example, as shown in FIG. 4, when the target lens shape of the lens LE is substantially a square, if the rotation speed at each lens rotation angle θi is constant, the movement speed of the contact point Pi in an area T2 where the radius vector length of the target lens shape drastically changes is lower than the movement speed of the contact point Pi in a linear area T1. In this case, according to the movement speed of the contact point Pi, the interval between the stripes is smaller in the part of the area T2 where the movement speed is low than in the part of the area T1 where the movement speed is high. On the contrary, by controlling the rotation speed at each lens rotation angle θi so that the movement speed of the contact point Pi is substantially constant, the interval between the stripes is substantially fixed, so that a better-looking polished surface can be obtained.

The rotation speed data at each rotation angle θi that makes the movement speed of the contact point Pi substantially constant can be obtained as follows: First, the average speed Vav when the rotation speed at each lens rotation angle θi (i=1, 2, 3, . . . , N) is the same is obtained based on the lens rotation speed V1 (second per rotation) so as to satisfy the lens rotation speed V1 (second per rotation) where the rotation speed per rotation of the lens is set. Moreover, the overall length of the lens periphery is obtained based on the target lens shape data which is the final shape of the lens LE, and the average movement distance Dav of the rotation angle θi is obtained based on the total number of divisions of the rotation angle θi. With respect to the average movement distance Day, the change rate ΔD of the movement distance between the adjoining contact points Pi is obtained at each rotation angle θi. The position of the contact point Pi at each rotation angle θi can be obtained by a known method based on the target lens shape data and the radius R of the polishing grindstone GR. Then, the average speed Vav at each rotation angle θi is changed according to the obtained change rate ΔD, thereby determining the rotation speed at each rotation angle θi. In a part where the rotation speed cannot be drastically changed at each rotation angle θi, the rotation speed is gradually changed. By doing this, processing can be performed where the movement speed of the contact point Pi is substantially constant at the lens rotation speed V1 (second per rotation).

In the embodiment, the normal size (diameter: 40 mm, peripheral length: 126 mm) is employed as an example of the target lens shape. However, it is preferable to take into account a target lens shape having a size practically used. For example, when a target lens shape having a peripheral length corresponding to a size of a 30-50 mm diameter is assumed, the peripheral length is 94-157 mm. If the lens rotation speed V1 and the grindstone rotation speed Vw are set for the target lens shape having the peripheral length of 157 mm corresponding to the size of 50 mm diameter to satisfy the condition that the average interval between the stripes is smaller than the human eye's resolution, the average interval between the stripes for the target lens shape having the peripheral length smaller than 157 mm becomes smaller. If the lens rotation speed V1 and the grindstone rotation speed Vw are set for the target lens shape having the peripheral length of 94 mm corresponding to the size of 30 mm diameter to satisfy the condition that the average interval between the stripes is larger than 2.00 mm, the average interval between the stripes for the target lens shape having the peripheral length smaller than 30 mm becomes larger.

Figure 5:
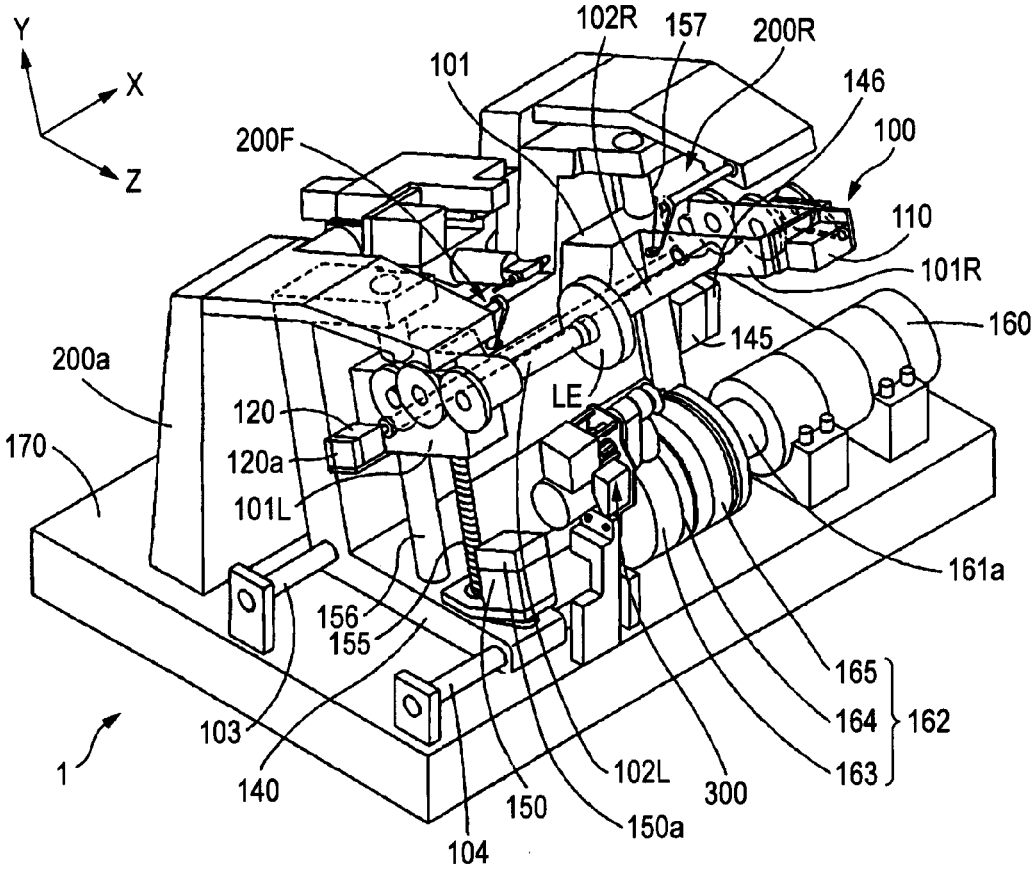
FIG. 5 is a schematic structural view of a processing mechanism of an eyeglass lens processing apparatus.

Next, the embodiment of the eyeglass lens processing apparatus according to the present invention will be described. FIG. 5 is a schematic structural view of a processing mechanism of the eyeglass lens processing apparatus.

A carriage unit 100 is mounted on a base 170 of a processing apparatus body 1. The periphery of the processed lens LE held between lens chuck shafts 102L and 102R of a carriage 101 is processed while being pressed against each grindstone of a cylindrical grindstone group 162 attached coaxially with a spindle (grindstone rotation shaft) 161*a*. The grindstone group 162 includes: a roughing grindstone 163 for plastic; a finishing grindstone 164 having a groove for beveling and a flat-processing surface; and a polishing grindstone 165 having a groove for beveling and a flat-processing surface. The spindle 161*a* is rotated by a motor 160. These members constitute a grindstone rotation unit.

The polishing grindstone 165 is used for putting gloss on the surface of the lens edge finished by the finishing grindstone 164 and making the surface transparent. For example, as the finishing grindstone 164, one whose particle size is #400 is applied, and as the polishing grindstone 165, one whose particle size is approximately #4000 is applied. While grindstones are suitably used as a polishing tool for the lens edge surface, the roughing tool and the finishing tool are not limited to grindstones, but cutters, etc. may be used thereas.

The lens chuck shaft 102L and the lens chuck shaft 102R are coaxially held by a left arm 101L and a right arm 101R of the carriage 101 so as to be rotatable, respectively. The lens chuck shaft 102R is moved toward the lens chuck shaft 102L side by a motor 110 attached to the right arm 101R, and the lens LE is held by the two lens chuck shafts 102R and 102L. The lens chuck shafts 102R and 102L are rotated in synchronism with each other through a rotation transmission mechanism such as a gear by a motor 120 attached to the left arm 101L. These members constitute a lens rotation unit (lens rotation unit).

The carriage 101 is mounted on a support base 140 movable along shafts 103 and 104 extending in the x-axis direction, and is linearly moved in an x-axis direction (the axial direction of the lens chuck shafts) by rotation of a motor 145. These members constitute an x-axis direction movement unit. Shafts 156 and 157 extending in the y-axis direction (the direction in which the axis-to-axis distance between the lens chuck shafts 102L and 102R and the grindstone spindle 161*a* is varied) are fixed to the support base 140. The carriage 101 is mounted on the support base 140 so as to be movable in the y-axis direction along the shafts 156 and 157. A motor 150 for y-axis movement is fixed to the support base 140. The rotation of the motor 150 is transmitted to a ball screw 155 extending in the y-axis direction, and the carriage 101 is moved in the y-axis direction by the rotation of the ball screw 155. These members constitute a y-axis direction movement unit (axis-to-axis distance varying unit).

In FIG. 1, lens edge position measurement units (lens edge position detection units) 200F and 200R are provided above the carriage 101. The lens edge position measurement unit 200F has a tracing stylus that is in contact with the front surface of the lens LE, and the lens edge position measurement unit 200R has a tracing stylus that abuts on the rear surface of the lens LE. By moving the carriage 101 in the y-axis direction based on the target lens shape data and rotating the lens LE with these tracing styluses being in contact with the front and rear surfaces of the lens LE, respectively, the edge positions on the lens front surface and the lens rear surface for lens periphery processing are simultaneously measured. As the structure of the lens edge position measurement units 200F and 200R, basically, the one described in Japanese Unexamined Patent Application Publication No. 2003-145328 (U.S. Pat. No. 6,790,124) may be used.

Moreover, a chamfering mechanism 300 is disposed on the front side of the apparatus body 1. Although the details of the chamfering mechanism 300 are omitted, the chamfering mechanism 300 has a grindstone rotation shaft rotated by a motor, and a chamfer-finishing grindstone and a chamfer-polishing grindstone for the lens front surface and the lens rear surface are attached to the grindstone rotation shaft. The grindstone rotation shaft of the chamfering mechanism 300 is moved from a retracted position to a predetermined processing position at the time of chamfering.

Figure 6:
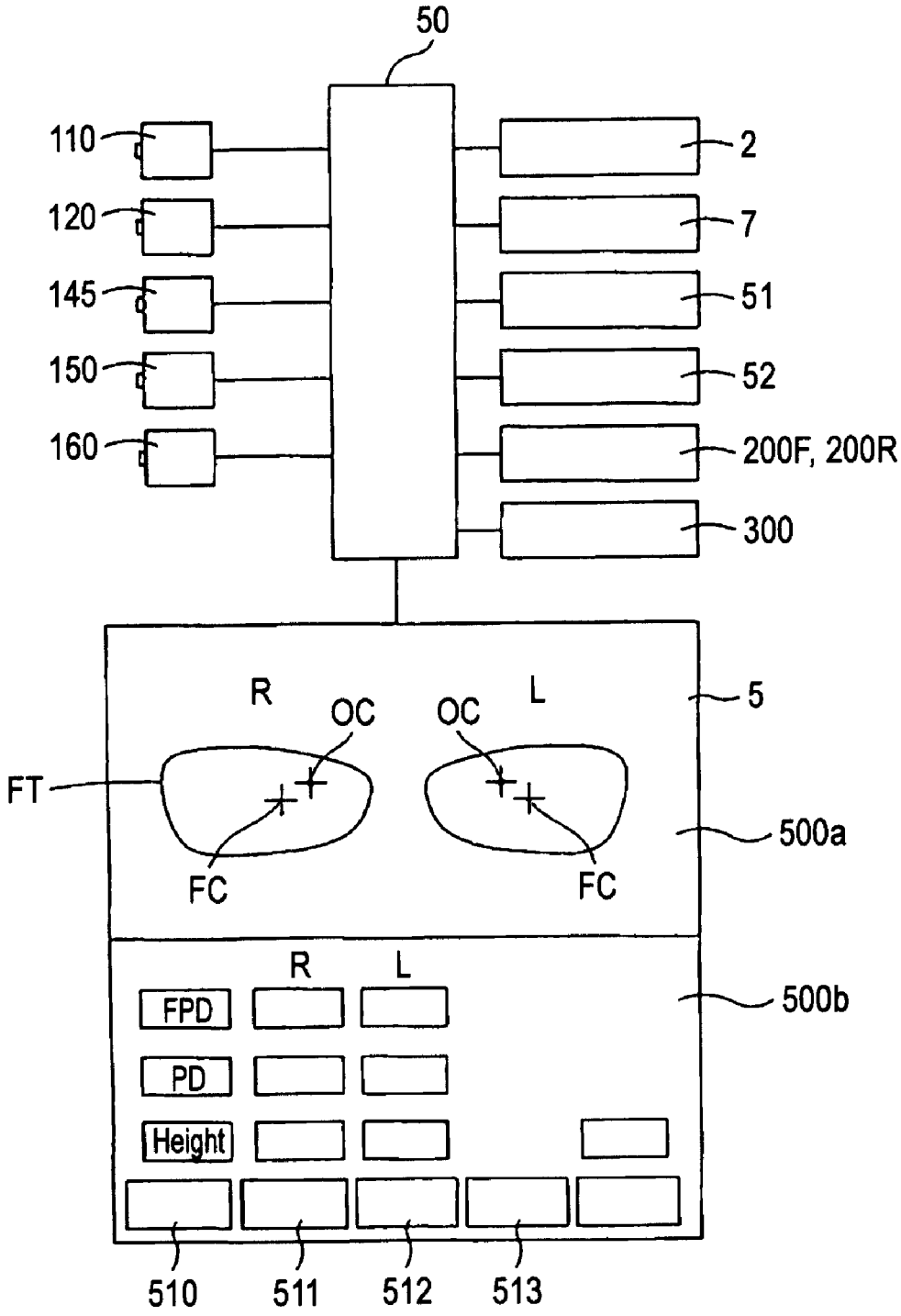
FIG. 6 is a block diagram of a control system of the apparatus.

FIG. 6 is a block diagram of a control system of the apparatus. To a control unit 50, the following are connected: an eyeglass frame shape measurement unit 2 (one described in Japanese Unexamined Patent Application Publication No. H04-93164 [U.S. Pat. No. 5,333,412], etc. may be used); a switch unit 7; a memory 51; the lens edge position measurement units 200F and 200R; a display 5 as a touch panel display unit and an input unit; and a grinding water supply unit 52 that supplies grinding water to the processed surface of the lens LE through a nozzle when the periphery of the lens LE is processed. The memory 51 stores conditions of the lens rotation speed and the grindstone rotation speed in each processing stage of roughing, finishing and polishing. The control unit 50 receives an input signal by a touch panel function of the display 5, and controls the display of graphics and information on the display 5. To the control unit 50, the motors 110, 145, 160, 120 and 150 and the chamfering mechanism 300 are also connected.

Next, the operation of the present apparatus will be described with focus on polishing. The target lens shape data (rn, □n) (n=1, 2, 3, . . . , N) of the lens frame obtained by a measurement by the eyeglass frame shape measurement unit 2 is input by pressing switches of the switch unit 7, and stored in the memory 51. Here, □n is the radius vector angle, and rn is the radius vector length. A target lens shape figure FT based on the input target lens shape data is displayed on a screen 500*a* of the display 5. A state where layout data such as the distance between the right and left pupils of the user (PD value), the distance between the centers of the right and left rims of an eyeglass frame F (FPD value) and the height of the optical center OC with respect to the geometric center FC of the target lens shape can be input is provided. The layout data is input by operating predetermined touch keys displayed on the screen 500*b*. Processing conditions such as the lens material, the frame kind and the processing mode (beveling, flat-processing) are set by touch keys 510, 511, 512, 513 and the like. As the lens material, a plastic lens, a polycarbonate lens or the like can be selected by the touch key 510. Whether to polish the lens periphery or not can be selected by the touch key 512. A case where a plastic lens is selected as the lens material, flat-processing is selected as the processing mode and polishing is selected will be described in the following:

When a start switch of the switch 7 is pressed after the lens LE is held by the lens chuck shafts, the lens edge position measurement units 200F and 200R are actuated by the control unit 50, and the edge positions on the lens front and rear surfaces based on the target lens shape data are measured. Whether the diameter of the unprocessed lens LE is insufficient for the target lens shape or not is checked by the lens edge position measurement. When beveling is set, the bevel path formed on the edge is calculated based on the edge position data of the lens front and rear surfaces.

After the lens edge position measurement is completed, the process shifts to roughing. The control unit 50 controls the driving of the x-axis movement motor 145 to locate the lens LE on the rough grindstone 163. Then, the control unit 50 controls the driving of the y-axis movement motor 150 while rotating the lens LE by the motor 120 based on roughing data calculated so that a lens margin allowed for finishing by the finishing grindstone 165 (for example, 1.0 mm) and a lens margin allowed for polishing by the polishing grindstone 165 (for example, 0.1 mm) are left with respect to the final target lens shape. The periphery of the lens LE is roughly processed by a plurality of rotations of the lens LE. The lens rotation speed in roughing is set, for example, to eight seconds per rotation. The speed of the rough grindstone 163 in roughing is set to the highest speed at which the motor 160 can rotate with stability so that the processing performance of the rough grindstone 163 is made the most of. In the present apparatus, the rough grindstone 163 is rotated at a rotation speed of 6000 rpm.

When roughing is completed, the process shifts to finishing. The control unit 50 controls the driving of the x-axis movement motor 145 to locate the lens LE on the flat-processing surface of the finishing grindstone 164. Then, the control unit 50 controls the y-axis movement motor 150 based on the finishing data calculated so that a predetermined lens margin allowed for polishing (0.1 mm) is left, and performs finishing by the finishing grindstone 164. The lens rotation speed is also set to eight seconds per rotation in finishing. The rotation speed of the finishing grindstone 164 is set to 6000 rpm which is the highest speed at which the motor 160 can rotate with stability as in roughing. The conditions of the rotation speed of the lens LE and the rotation speed of each grindstone in roughing and in finishing are stored in the memory 51 in advance.

When finishing is completed, the process shifts to polishing. The control unit 50 controls the driving of the x-axis movement motor 145 to locate the lens LE on the flat-processing surface of the polishing grindstone 165. Then, the control unit 50 controls the y-axis movement motor 150 based on the polishing data calculated so as to grind the lens margin allowed for polishing (0.1 mm), and polishes the periphery of the lens LE by the polishing grindstone 165. The polishing data is calculated by rotating the lens LE at each minute rotation angle θi (i=1, 2, 3, . . . , N) and obtaining the axis-to-axis distance YDi from the center LO of the lens chuck shafts 102R and 102L and the center DC of the spindle (grindstone rotation shaft) 161*a* when the target lens shape is in contact with the processing surface of the polishing grindstone 165 at each rotation angle θi based on the final target lens shape data and the radius R of the polishing grindstone 165. The polishing data is obtained as (YDi, θi) (i=1, 2, 3, . . . , N) (see FIG. 4). Although flat-processing is shown as an example, for polishing data when beveling is set, the movement data XDi (i=1, 2, 3, . . . , N) of the x-axis direction component is further added based on the bevel path data, and the polishing data is obtained as (YDi, XDi, θi) (i=1, 2, 3, . . . , N).

At the time of this polishing, while the lens margin allowed for polishing (0.1 mm) of after finishing is processed by a plurality of rotations of the lens LE, at least at the final one rotation of the lens, as described above, conditions are set that suppress the generation of the cyclic stripes, and the driving of the motors 120 and 160 is controlled based on the lens rotation speed V1 and the grindstone rotation speed Vw stored in the memory 51. Further, preferably, the lens rotation speed at each rotation angle θi is obtained based on the target lens shape data, the radius R of the polishing grindstone 165 and the lens rotation speed V1 so that the movement speed of the contact point Pi between the polishing grindstone 165 and the lens LE is substantially constant, and the driving of the motor 120 is controlled.

When the lens margin allowed for polishing (0.1 mm) is processed by a plurality of rotations of the lens LE, the following two control methods are available: A first control example in polishing will be described. In the first control example, when the lens margin allowed for polishing (0.1 mm) is processed by a plurality of rotations of the lens LE, processing is performed in two stages between which the lens rotation speed and the rotation speed of the polishing grindstone 165 are different. In the first stage, mainly, the driving of the motors 120 and 160 is controlled at a lens rotation speed and a grindstone rotation speed that are set so that most of the lens margin allowed for polishing (0.1 mm) is efficiently processed (this condition is also stored in the memory 51). In the second stage including the final one rotation of the lens, the driving of the motors 120 and 160 is controlled by the lens rotation speed and the grindstone rotation speed that are set by the above-described first or the second method.

The processing conditions of the first stage are set so that no burn is caused on the processed surface of the lens LE and the processing efficiency is high with the polishing grindstone 165 whose particle size is #4000. For example, the grindstone rotation speed Vw is 2000 rpm, and the lens rotation speed V1 is 15 seconds per rotation. By rotating the lens LE twice under the processing conditions of the first stage, most of the lens margin allowed for polishing (0.1 mm) is processed. In the next second stage, in order that there is no unprocessed part left and the generation of the cyclic stripes is suppressed, the lens rotation speed and the grindstone rotation speed are changed from the conditions that are set by the above-described first or second method, and the lens is rotated twice for polishing. In the present apparatus, in order to avoid size increase and cost increase of the motor 160, a motor with a rotatory power of 6000 rpm is used. Moreover, in order not to prolong the processing time of polishing, as a method of suppressing the generation of the cyclic stripes, the lens rotation speed V1 and the grindstone rotation speed Vw of the conditions that are set by the second method are stored in the memory 51. For example, the lens rotation speed V1 is four seconds per rotation, and the grindstone rotation speed Vw is 500 rpm. By rotating the lens twice under this condition, a polished surface where cyclic stripes are inconspicuous is obtained, so that the polishing quality is improved.

In changing the lens rotation speed V1 and the grindstone rotation speed Vw from the ones of the first stage to the ones of the second stage, when a sudden change of the lens rotation speed is difficult to be performed, the part where the lens is rotated a half turn or a quarter turn is provided as a transition area where the speed can be gradually changed. Although the lens is necessarily rotated at least once in the second stage, to avoid the occurrence of an unprocessed part as much as possible, it is preferable that the lens be rotated twice.

A second control example will be described. The second control example is a control method in which polishing is performed from the initial stage under the conditions that are set by the first or the second method in order to suppress the generation of the cyclic stripes. In this case, if the lens margin allowed for polishing per lens rotation is too large, the possibility of occurrence of a burn on the processed surface of the lens is high. Therefore, the control unit 50 controls the driving of the motor 150 as the y-axis direction movement unit based on the polishing data calculated so that a minute lens margin allowed for polishing is processed every lens rotation, and rotates the lens until the minute lens margin allowed for processing becomes the overall lens margin allowed for polishing. For example, the minute lens margin allowed for processing per lens rotation is 0.01 mm and the lens is rotated ten times, whereby the overall lens margin allowed for polishing which is 0.1 mm is processed.

In the second control example, even under the conditions that are set by the first method where the interval between the cyclic stripes is small, a polished surface of the lens where the cyclic stripes are inconspicuous can be obtained. However, for example, when the grindstone rotation speed Vw is set to 6000 rpm and the lens rotation speed V1 is set to 25.2 seconds per rotation, the processing where the lens is rotated ten times increases the processing time. For this reason, in the second control example, it is preferable to apply the conditions that are set by the second method where the interval between the cyclic stripes is large. For example, when the grindstone rotation speed Vw is set to 500 rpm and the lens rotation speed V1 is set to five seconds per rotation, the processing time is 50 seconds even if the lens is rotated ten times, so that the processing time is not longer than before.

By the above-described first or second control, the periphery of the lens LE is accurately polished. When chamfering is set, a motor that rotates a chamfer-polishing grindstone at the lens rotation speed V1 and the grindstone rotation speed Vw set under conditions similar to the above-described ones is also controlled in chamfer polishing.

When a polycarbonate lens is selected by the touch key 510 and polishing is selected by the touch key 512, the lens periphery is roughly processed by the rough grindstone 163, and finished by the polishing grindstone 165. In the stage of the roughing and the finishing of the polycarbonate lens, the grinding water supply by the grinding water supply unit 52 is stopped. After finishing is completed, the process shifts to polishing by the polishing grindstone 165. In the polishing of the polycarbonate lens, processing is controlled by a first stage in which processing is performed without the supply of grinding water and then a second stage in which processing is performed with the supply of grinding water. The lens margin allowed for polishing is set, for example, to 0.1 mm as in the case of plastic.

In the first stage of polishing, the above-described first control example is applied. That is, the driving of the motors 120 and 160 is controlled by the lens rotation speed and the grindstone rotation speed that are set so that most of the lens margin allowed for polishing (0.1 mm) is efficiently processed. For example, the grindstone rotation speed Vw is 2000 rpm, and the lens rotation speed V1 is 15 seconds per rotation.

In the second stage of polishing, grinding water is supplied, and the driving of the motors 321 and 120 is controlled by the grindstone rotation speed Vw and the lens rotation speed V1 of the conditions that are set so as to make the cyclic stripes inconspicuous. In the polishing of the polycarbonate lens, the supply of the grinding water decreases the heat of the processed surface, and the processed surface is processed so as to have burnish. At this time, by applying the grindstone rotation speed Vw and the lens rotation speed V1 of the above-described conditions, the cyclic stripes are inconspicuous, so that a good-looking polished surface can be obtained.

What is claimed is:

1. An eyeglass lens processing apparatus for processing a peripheral edge of an eyeglass lens, comprising:

a lens rotating unit including a lens chuck shaft for holding the lens and a motor for rotating the lens chuck shaft;

a grindstone rotating unit including a spindle attached to a polishing grindstone and a motor for rotating the spindle;

an axis-to-axis distance varying unit including a motor for changing an axis-to-axis distance between the lens chuck shaft and the spindle;

a data input unit which inputs target lens shape data;

a memory which stores a rotation speed of the lens and a rotation speed of the polishing grindstone, which satisfy a condition in which an average interval between cyclic stripes appearing on a processed edge surface of the lens which are generated due to height fluctuations of a processing surface of the polishing grindstone with respect to a rotation center of the spindle during one rotation of the polishing grindstone is smaller than human eye's resolution or is larger than 2 mm; and a processing control unit for performing polishing by controlling the lens rotating unit, the grindstone rotating unit and the axis-to-axis distance varying unit based on the input target lens shape data so as to polish the peripheral edge of the lens, which has been finished, by a lens margin allowed for polishing by the polishing grindstone, wherein the processing control unit controls the lens rotating unit and the grindstone rotating unit based on the lens rotating speed and the grindstone rotating speed stored in the memory at least at the final one rotation of the lens.

2. The lens processing apparatus according to claim 1, wherein the lens rotating speed and the grindstone rotating speed satisfy a condition in which the average interval between the stripes which are generated when the lens is polished into the target lens shape having a normal peripheral length is smaller than the human eye's resolution or larger than 2 mm.

3. The lens processing apparatus according to claim 1, wherein the lens rotating speed and the grindstone rotating speed satisfy a condition in which the average interval between the stripes which are generated when the lens is polished into the target lens shape having a peripheral length corresponding to a size of 30-50 mm in diameter is smaller than the human eye's resolution or larger than 2 mm.

4. The lens processing apparatus according to claim 1, wherein the average interval between the stripes is a value obtained by dividing a peripheral length of the target lens shape by N, where N=the lens rotating speed time per one rotation×the grindstone rotating speed rotation per time.

5. The lens processing apparatus according to claim 4, wherein the lens rotating speed and the grindstone rotating speed satisfy a condition in which N is larger than 2520 or smaller than 63.

6. The lens processing apparatus according to claim 1, wherein the processing control unit performs the polishing by changing a rotation speed of the lens and a rotation speed of the polishing grindstone according to a first stage in which most of the lens margin allowed for polishing is polished by rotating the lens a predetermined rotation and a second stage in which the lens is polished by rotating the lens a predetermined rotation including the final one rotation, at the first stage, the processing control unit controls the lens rotating unit and the grindstone rotating unit based on a rotation speed of the lens and a rotation speed of the polishing grindstone which are set to satisfy a condition that no burn is caused on the processed edge surface of the lens, and at the second stage, the processing control unit controls the lens rotating unit and the grindstone rotating unit based on the lens rotation speed and the grindstone rotation speed stored in the memory.

7. The eyeglass lens processing apparatus according to claim 1, the processing control unit controls the axis-to-axis distance varying unit so as to polish a minute lens margin every lens rotation, and controls the lens rotating unit and the grindstone rotating unit based on the lens rotation speed and the grindstone rotation speed stored in the memory until the minute lens margin becomes the overall lens margin allowed for polishing.

8. The eyeglass lens processing apparatus according to claim 1, the processing control unit controls the lens rotating unit to rotate the lens at the constant speed of the lens rotation speed stored in the memory at least at the final one rotation.

9. The eyeglass lens processing apparatus according to claim 1, wherein the processing control unit obtains a speed at each rotation angle of the lens based on the target lens shape and a diameter of the polishing grindstone so as to satisfy the lens rotation speed stored in the memory and so that a movement speed of a point where the lens is in contact with the polishing grindstone is substantially constant, and controls the lens rotating unit based on the obtained speed at least at the final one rotation.

* * * * *